US006811353B2

(12) United States Patent
Madison

(10) Patent No.: US 6,811,353 B2
(45) Date of Patent: Nov. 2, 2004

(54) AQUIFER RECHARGE VALVE AND METHOD

(76) Inventor: Kent R. Madison, 73700 Highway 207, Echo, OR (US) 97826

( * ) Notice: Subject to any disclaimer, the term of this patent is extended or adjusted under 35 U.S.C. 154(b) by 0 days.

(21) Appl. No.: 10/197,055

(22) Filed: Jul. 16, 2002

(65) Prior Publication Data

US 2003/0180094 A1 Sep. 25, 2003

Related U.S. Application Data

(60) Provisional application No. 60/366,150, filed on Mar. 19, 2002.

(51) Int. Cl.[7] ..... E02B 34/14; E02B 13/00

(52) U.S. Cl. ..... 405/41; 405/36; 405/40; 166/326; 166/332.6

(58) Field of Search ..... 405/36, 40, 41, 405/50; 166/51, 50, 278, 320, 321, 326, 334.1, 334.4, 332.6

(56) References Cited

U.S. PATENT DOCUMENTS

| | | | | |
|---|---|---|---|---|
| 353,548 | A | | 11/1886 | Franklin |
| 922,060 | A | | 5/1909 | Stockdon |
| 966,911 | A | | 8/1910 | Hardsocg |
| 1,285,769 | A | | 11/1918 | Melcher |
| 1,799,373 | A | | 4/1931 | Humason |
| 1,909,179 | A | | 5/1933 | Huffman |
| 1,919,856 | A | | 7/1933 | McGeorge |
| 1,919,955 | A | | 7/1933 | Leech et al. |
| 2,091,482 | A | | 8/1937 | McCreary et al. |
| 2,654,395 | A | | 10/1953 | Kaye |
| 2,664,859 | A | | 1/1954 | Green |
| 2,693,203 | A | | 2/1954 | Hempel |
| 3,112,764 | A | | 12/1963 | Anderson et al. |
| 3,120,267 | A | | 2/1964 | Bayless |
| 3,220,693 | A | | 11/1965 | Dickson |
| 3,379,405 | A | | 4/1968 | Natho |
| 3,497,004 | A | | 2/1970 | Page, Jr. |
| 3,679,169 | A | | 7/1972 | Bedo et al. |
| 3,735,541 | A | * | 5/1973 | Vanderlinde ..... 405/244 |
| 3,761,053 | A | | 9/1973 | Bedo et al. |
| 3,908,536 | A | | 9/1975 | Bajcar |
| 3,937,247 | A | | 2/1976 | Van der Wal |
| 4,041,982 | A | | 8/1977 | Lindner |
| 4,047,695 | A | | 9/1977 | Cleveland et al. |
| 4,080,982 | A | | 3/1978 | Maezawa |
| 4,114,851 | A | | 9/1978 | Shivak et al. |
| 4,134,454 | A | | 1/1979 | Taylor |
| 4,149,698 | A | | 4/1979 | Deaton |
| 4,154,263 | A | | 5/1979 | Cary |
| 4,199,272 | A | * | 4/1980 | Lacey ..... 405/36 |
| 4,248,305 | A | | 2/1981 | Scarbrough et al. |
| 4,280,569 | A | | 7/1981 | Mount, II |
| 4,285,495 | A | | 8/1981 | King |
| 4,330,012 | A | | 5/1982 | Chadwick |
| 4,375,821 | A | | 3/1983 | Nanao |
| 4,377,177 | A | | 3/1983 | Claycomb |
| 4,508,138 | A | | 4/1985 | Dixon |

(List continued on next page.)

FOREIGN PATENT DOCUMENTS

| | | | |
|---|---|---|---|
| CH | 282823 | | 10/1952 |
| EP | 251101 | * | 1/1988 |
| GB | 952007 | | 3/1964 |

*Primary Examiner*—Jong-Suk (James) Lee
(74) *Attorney, Agent, or Firm*—Klarquist Sparkman LLP

(57) ABSTRACT

An aquifer recharge valve assembly comprises a valve movable along the interior of a pipe section to open and close aquifer recharge openings through the pipe section. The position of the valve controls the extent to which the recharge openings are available for delivery of recharge water into the aquifer. The valve may be a seamless resilient cylinder which expands due to well head pressure to assist in sealing the recharge openings when the valve is closed.

30 Claims, 9 Drawing Sheets

U.S. PATENT DOCUMENTS 4,520,846 A 6/1985 Dixon
4,540,022 A 9/1985 Cove
4,569,370 A 2/1986 Witt
4,621,655 A 11/1986 Roche
4,691,778 A 9/1987 Pyne
4,787,599 A * 11/1988 Nyboer ..... 251/148
4,821,622 A 4/1989 Burk
5,014,746 A 5/1991 Heymann
5,090,450 A 2/1992 Pelech et al.
5,172,717 A 12/1992 Boyle et al.
5,176,164 A 1/1993 Boyle
5,316,081 A 5/1994 Baski et al.
5,503,363 A 4/1996 Wallace
5,511,582 A * 4/1996 Hudson ..... 137/494
5,547,029 A 8/1996 Rubbo et al.
5,618,022 A 4/1997 Wallace
5,771,976 A 6/1998 Talley
5,871,200 A 2/1999 Wallace et al.
5,960,816 A * 10/1999 Mills et al. ..... 137/202
5,971,007 A * 10/1999 Harcourt et al. ..... 251/325
6,073,906 A 6/2000 Wallace
6,206,021 B1 3/2001 Hartman et al.
6,286,594 B1 * 9/2001 French ..... 166/334.4
6,334,486 B1 * 1/2002 Carmody et al. ..... 166/334.4
6,338,466 B1 * 1/2002 Wallace et al. ..... 166/320
2003/0056951 A1 * 3/2003 Kaszuba ..... 166/332.6

* cited by examiner

AQUIFER RECHARGE VALVE AND METHOD

CROSS REFERENCE

This application is based on and claims the benefit of U.S. Provisional Patent Application No. 60/366,150, filed on Mar. 19, 2002. The entire disclosure of the provisional application is considered to be part of the disclosure of the following application and is hereby incorporated by reference herein.

BACKGROUND

The present invention relates to a method and apparatus for selectively injecting water into an aquifer to recharge the aquifer, for example during a rainy time of year when water is more available for use in recharging the aquifer.

In many geographic areas, wells are the primary source of water for use in agriculture and for other purposes. In addition, in many areas there is a so-called rainy or wet season where excess water is available. This excess water may be stored in ponds or reservoirs. This excess water may selectively be reintroduced into an aquifer to replenish or recharge the aquifer so that the water stored in the aquifer is then available for pumping from a well during drier times of the year.

In effect, the ground itself is used as a water storage facility.

Various types of recharge valves have been used in the past for delivery of water to an aquifer for recharging the aquifer. However, these known devices suffer from a number of disadvantages. For example, they may be prone to leakage. Consequently, when water is being drawn from the well during a normal pumping operation, some of the water that would otherwise be drawn from the well leaks through the recharge valve.

Therefore, a need exists for an improved aquifer recharge valve assembly and method.

DETAILED DESCRIPTION

The description proceeds with reference to several embodiments. The present invention is directed toward novel and unobvious features and method acts relating to an aquifer recharge valve and system both alone and in various combinations and subcombinations with one another.

Figure 1:
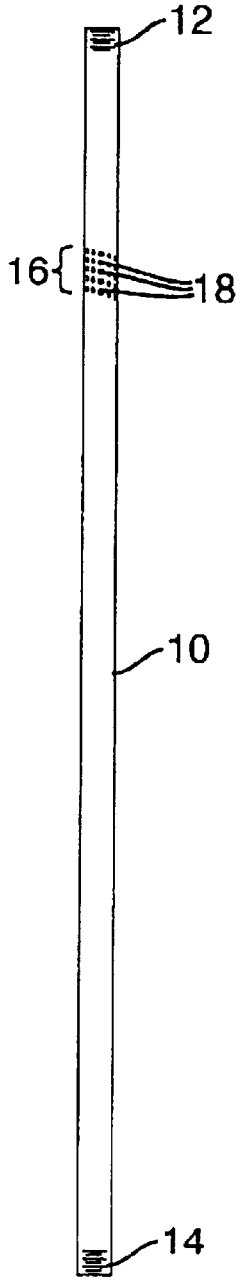
FIG. 1 illustrates an exemplary pipe section provided with a plurality of water recharge orifices.

FIG. 1 shows a pipe section 10 for inclusion in a pump column of a well. For example, pipe section 10 may be a six inch inside diameter steel pipe having threads 12, 14 at its opposite ends for coupling to associated pipe components. The pipe section 10 includes at least one aquifer recharge outlet through which water may pass to recharge an aquifer. However, desirably a plurality of aquifer recharge outlets are provided at spaced locations about the circumference of the pipe section 10. This reduces the aquifer mining that can take place when water passes through an aquifer recharge orifice toward the aquifer, with the mining being more of a problem if only one large orifice is used. As explained in greater detail below, the orifices may be of any suitable shape and pattern. In FIG. 1 the aquifer recharge orifices are arranged in a spiral pattern along a pipe section 16 with some of these orifices being indicated at 18 in FIG. 1. The pipe section 10 may be of any suitable length and in FIG. 1 is shown as a twenty foot pipe section. Typically, pipe section 10 ranges from about five feet to about twenty feet, although again this is variable.

Figure 2:
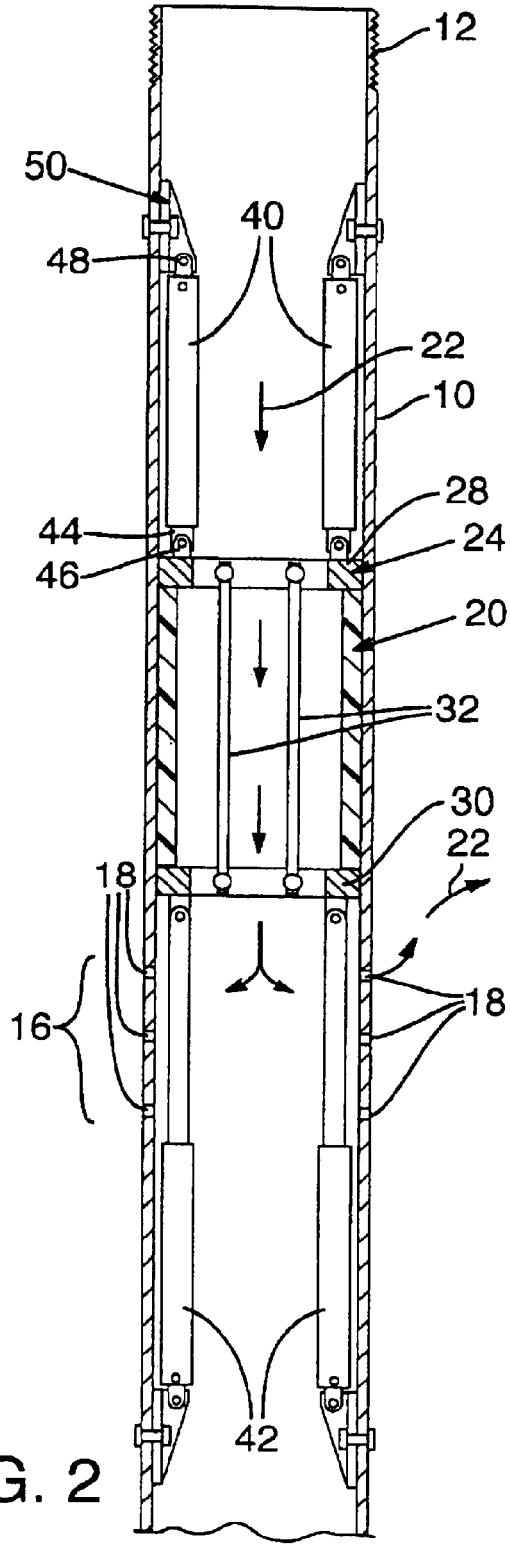
FIG. 2 is a vertical sectional view of a portion of the pipe of FIG. 1 showing an embodiment of an aquifer recharge valve.

FIG. 2 illustrates a vertical sectional view through a portion of pipe section 10 containing an exemplary aquifer recharge valve in accordance with one embodiment.

The illustrated FIG. 2 embodiment comprises a valve 20 positioned within the interior of pipe section 10 and movable between a first position (shown in FIG. 2) in which the valve 20 does not overlie and seal the orifices 18 to a second position in which the valve 20 overlies and closes these orifices. The pipe section 10 is shown in FIG. 2 with the valve 20 above the apertures 18. Other orientations may be used. For example, the pipe section 10 may be inverted from the position shown in FIG. 2. In such a case, the valve 20 would be below the openings 18 and would be shifted upwardly to cover the openings. This inverted orientation is more desirable if the well is to be used a greater extent for recharge applications as the recharge water would not have to flow past valve supporting structures to reach these openings. When open, as shown in FIG. 2, a flow path (indicated schematically by arrows 22) exists through the center of the pipe section 10 and outwardly through the orifices 18. Desirably, the valve 20 comprises a tube having an outside diameter which is sized slightly less than the inside diameter of pipe section 10. For example, if pipe section 10 has an inside diameter of six inches, the outside diameter of valve 20 may be 5 and $^{15}/_{16}$ inches. In addition, valve 20 is ideally of a material with some flexibility such that when the valve is positioned to overlie apertures 18, the water pressure within pipe section 10 (the head in the pump column) forces the valve outwardly to provide a good seal of openings 18 against leakage. Because valve 20 is positioned inside pipe section 10, the water pressure in the pipe column assists in maintaining the valve in a closed position as water is being pumped from the well. Valve 20 may be of any suitable material. As a desirable example, valve 20 may be of a polymer material and may be formed, as by machining or otherwise, as a seamless cylinder. In addition, the valve 20 may be nine inches to one foot long. As a specific example, valve 20 may have a one-half inch thick wall and be formed of ultra-high molecular weight polyethylene so that it has some resiliency to assist in accomplishing the seal. This material also slides easily against the interior wall of the pipe section 10. The valve 20 is not limited to this specific material. Other examples of suitable valve materials include: Polyvinyl chloride (PVC); HDPE (high density polyethylene); Nylon (Zytel); or any other semi-rigid or resilient material. Multi-material components may also be used.

The valve 20 may be positioned within a support structure, such as a cage structure. One form of a cage structure is indicated generally at 24. The illustrated cage structure is of a durable material with stainless steel being a specific example. Cage structure 24 comprises upper and lower cross-pieces 28, 30 with the valve 20 retained between the cross-pieces. In the specific form shown, top and bottom pieces 28, 30 comprise annular rings. These rings may, for example, have a one inch height and one inch thickness. The rings when used with a six inch inside diameter pipe section 10 may have an outer diameter of, for example, 5 and 15/16 inches. A plurality of braces, some being indicated at 32, extend longitudinally and may be bolted or otherwise fastened to the respective top and bottom pieces 28, 30. In the illustrated embodiment, four such braces 32 are included and are spaced apart at 90 degree intervals about the rings 28, 30. Braces 32 may comprise, as a specific example, one-quarter inch diameter stainless steel thrust rods. The respective ends of the thrust rods may be inserted into associated holes drilled in the top and bottom pieces 28, 30. The rods may be held in place within such holes by respective set screws extending through the rods from the interior surface of the top and bottom pieces. The top and bottom pieces need not be annular in shape but do permit the passage of water past these pieces.

A drive mechanism is provided for shifting the cage and thus the valve between the open and closed positions. It should be noted that a plurality of open positions are provided depending upon the number of apertures 18 that are exposed. In one specific form, the drive mechanism comprises at least one, and in this case two, valve closing cylinders 40 and at least two valve operating cylinders 42. The cylinders 40, 42 in the illustrated form are single action cylinders, although dual action cylinders may be used as an alternative. With reference to cylinder 40, with the other cylinders being similarly mounted, the piston end 44 of cylinder 40 is pivotally coupled to an ear or mount 46 which projects outwardly from top piece 28. The cylinder housing end 48 of cylinder 40 is pivoted to a mount 50 which is coupled, for example bolted, to the pipe section 10 or to a mount coupled thereto. Extension of cylinders 42 shifts valve 20 upwardly in the FIG. 2 example and exposes the apertures 18 with the number of apertures that are exposed depending upon the extent of the upward shifting of the valve 20. Conversely, extension of cylinders 40 shifts the cage 24 and valve 20 downwardly in the FIG. 2 example. When valve 20 is in a fully closed position, the valve overlies all of the apertures 18. The cylinders 40 and 42 may be operated cooperatively to position the valve 20 at any desired position.

Figure 3:
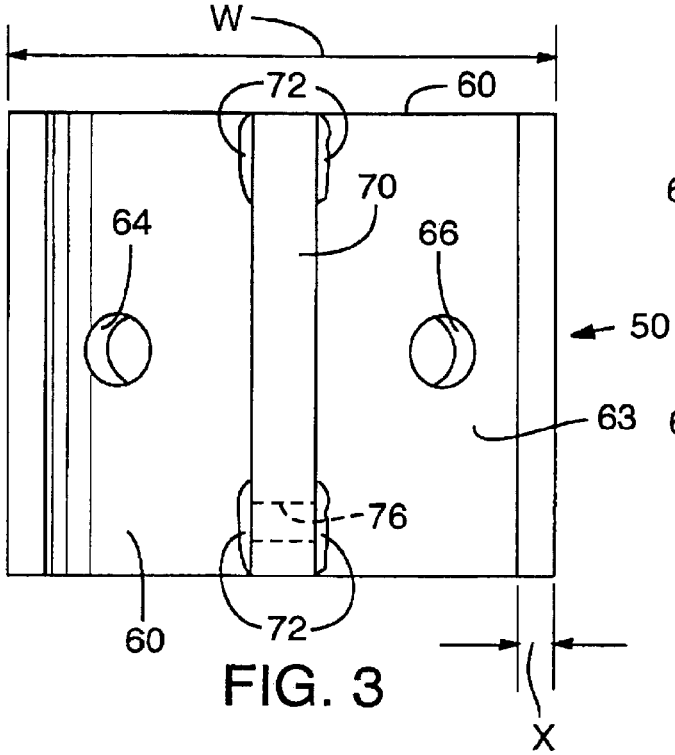
FIG. 3 is a front view of a cylinder mount usable in the recharge valve of FIG. 2.
Figure 5:
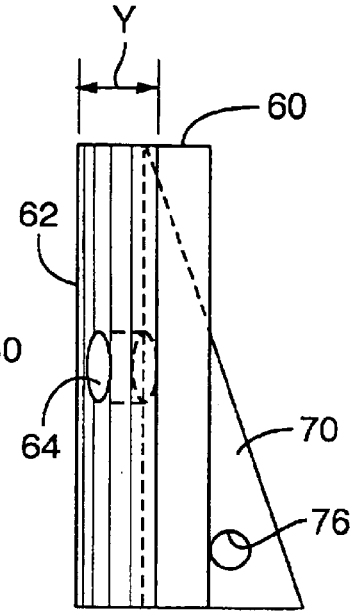
FIG. 5 is a side view of the mount of FIG. 3.
Figure 4:
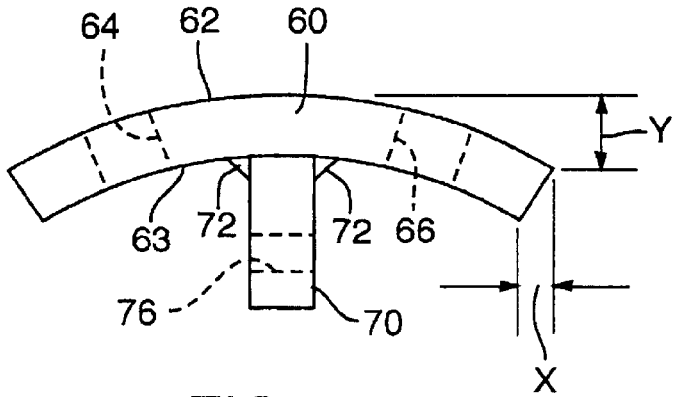
FIG. 4 is a top view of the mount of FIG. 3.

One form of mount 50 is shown in FIGS. 3–5, it being understood that any suitable mounting structure may be used. The structure illustrated in FIGS. 3–5 is mechanically simple and strong. With reference to these figures, mount 50 comprises a curved wall 60 having a back surface 62 which may conform to the curvature of the interior of pipe section 10. The wall 60 also has a concave front surface 63 in this example. First and second fastener receiving openings 64, 66 may be provided at either side of the longitudinal centerline of mount 50. Openings 64, 66 may, for example, be sized to receive 2½ inch stainless steel fine threaded bolts. The bolts may each be inserted through an associated aperture in pipe section 10 and through one of the respective openings 64, 66. A respective nut, for example, at the interior of the pipe section 10 may be used to secure each of these bolts. Lock washers (not shown) may also be used. As a specific example, mount 50 may be of stainless steel with wall 60 being ⅜ inch in thickness. Although variable, the mount may have a width w of three inches and may be of the same height. The width x indicates that portion of the edge of wall 60 visible in the front view. The dimension y indicates that portion of the rear wall 62 which is visible in the side view shown in FIG. 5. A cylinder mount portion 70 is secured, as by welding the welds 72 to the interior surface 63 of wall 60. The cylinder mount portion 70 may be of any suitable configuration, although in the form shown the portion 70 is depicted as being of a generally triangular shape. Although variable, mount portion 70 may extend the full height of piece 60. Portion 70 may be of a durable material. As a specific example, portion 70 may be one-half inch in thickness and of stainless steel. A fastener receiving opening 76 extends through mount portion 70. The cylinder housing end 48 is fastened, for example by a bolt, extending through a mounting opening in the cylinder housing end and through opening 76 to thereby mount the cylinder in place.

In a typical construction, the cylinders have an eight inch stroke, although this is variable, and may depend in part upon the length of that portion of the pipe section 10 which includes the aquifer recharge apertures. That is, although not required, a desirable construction involves having a sufficient cylinder stroke to move the valve 20 enough of a distance to open all of the aquifer recharge apertures when the valve is shifted to its full open position and to close all of the aquifer recharge apertures when the valve is shifted to its fully closed position.

Figure 6:
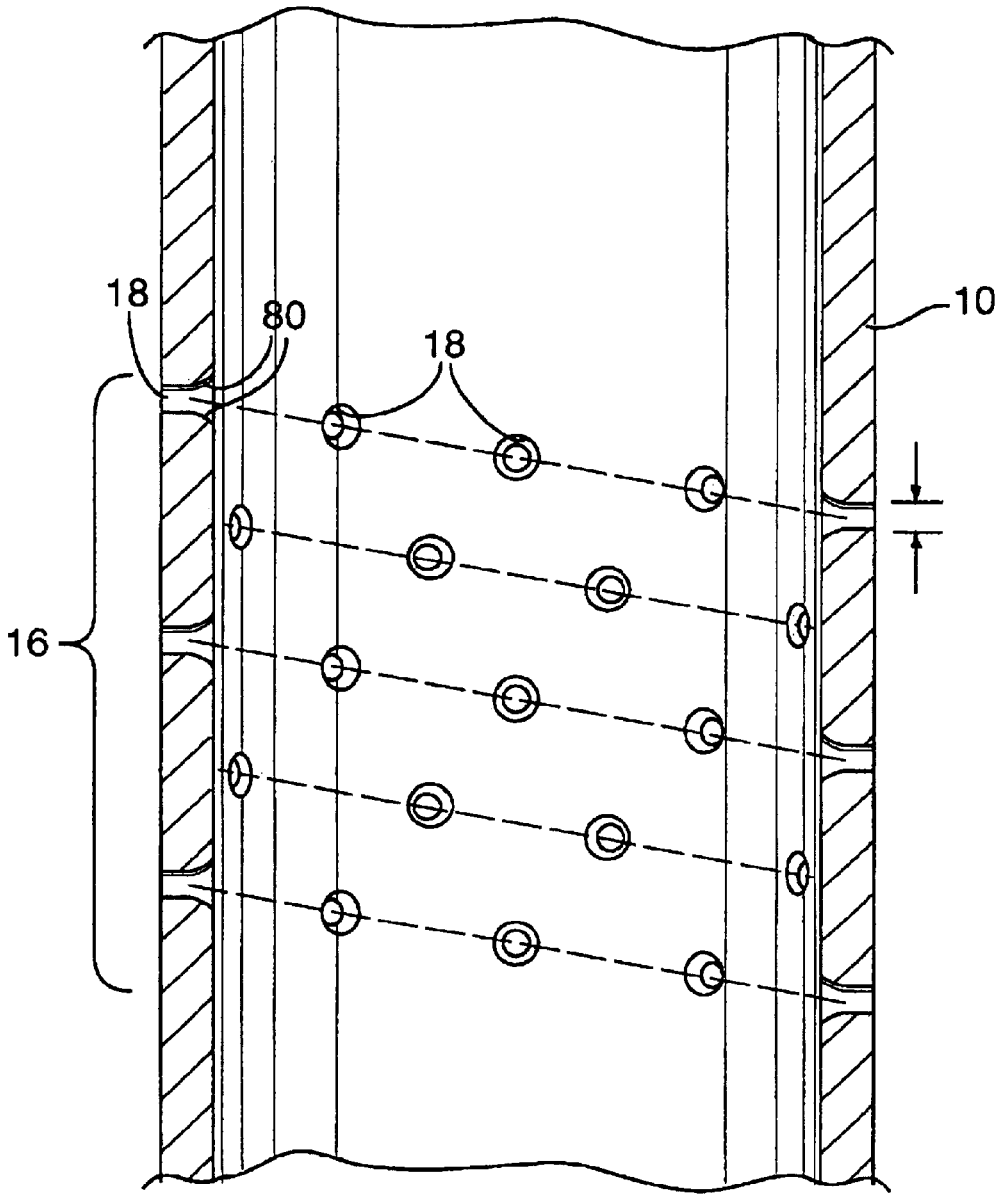
FIG. 6 is a vertical sectional view through a portion of the pipe section of FIG. 1 and shows an exemplary pattern of water recharge orifices.

FIG. 6 illustrates the section of pipe 16 having the apertures 18. Again, it should be noted that at least one such aperture is provided. However, it is more desirable to include a plurality of apertures spaced about the circumference of pipe section 10. This approach disperses the water being used to recharge the aquifer through a plurality of openings and reduces the mining of the aquifer that could otherwise take place by a high volume of water passing through one or only a few apertures toward the aquifer. The size and number of apertures may be varied for a particular application. That is, for a given head pressure during recharging of a well and a desirable flow rate of recharge water into the aquifer, one can determine the number and size of apertures that are required. In the illustrated embodiment, forty openings are provided which are each one-fourth inch in diameter. These openings are desirably arranged in a spiral pattern as shown in FIG. 6 as opposed to being in respective rings with each ring being at the same elevation. As a result, the integrity and strength of the pipe is increased. Although less desirable, the openings may be arranged in rings or other arrangements. In addition, as the valve is moved upwardly or downwardly, the change in the exposed orifices is almost linear. This facilitates the control of a flow rate during aquifer recharge operations. As shown in FIG. 6, for one of the apertures 18, the apertures may have rounded edges 80 at the interior side of the pipe section 10 to facilitate the smoother flow of water through the apertures during an aquifer recharge operation. This also reduces the possibility of the apertures scratching the valve 20 as it is slid past the apertures.

In the illustrated example with forty apertures of one-fourth inch diameter and with a valve head pressure of 520 feet of head, the flow rate through all the apertures is about 1970 gallons per minute. In general, this flow would be distributed equally through the various apertures. In this example, it is assumed that all forty apertures are open.

If single action cylinders are used, the cylinders are always pushing against and reinforcing the cage.

Figure 7:
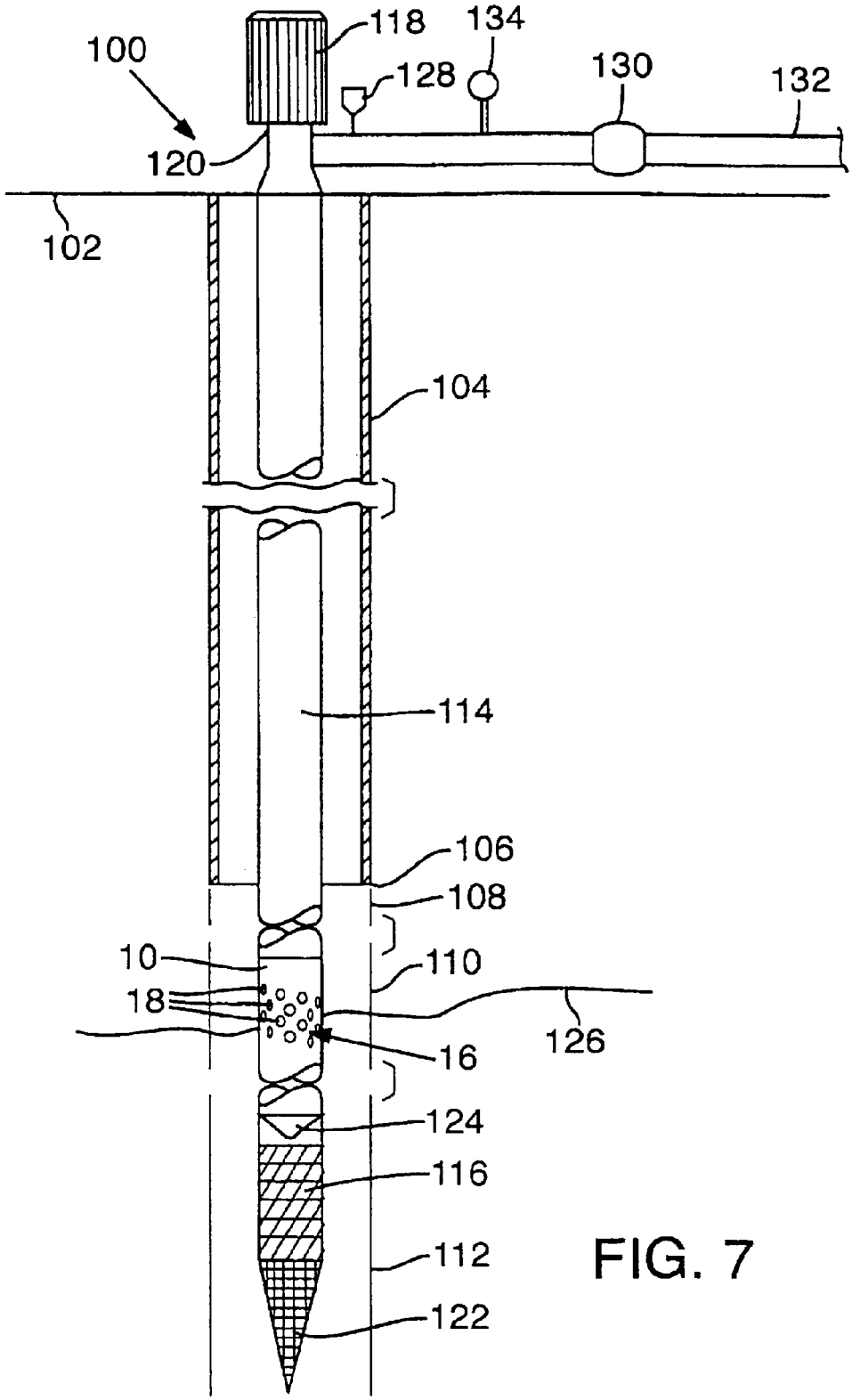
FIG. 7 illustrates an exemplary well with a recharge valve of FIG. 1 installed.

In one specific application shown in FIG. 7, a well 100 is indicated and extends downwardly from ground surface 102. In this example, the upper portion of the well has a well casing 104 which in this example ends at 106. The well casing may be any depth and typically depends on soil conditions. A well is typically cased deep enough to minimize the possibility of collapsing of the walls of the well. The lower uncased portions of the well are indicated at 108, 110 and 112. A pump column is indicated at 114 with pipe section 10 being included in the pump column. One or more pump bowls are indicated at 116 with respective impellers (not shown) driven by an electric or other motor 118 located at the well head 120. A screen is illustrated at 122 for blocking the passage of grit into the pump bowls 116. A check valve 124 restricts the downward flow of water through the valve toward the pump bowls. The static water level in the well is indicated in this example at 126. A conventional vacuum 128 maintains a vacuum in the line in a conventional manner to self-prime the pump. A flow rate meter 130 (with a McCrometer Model MW506, Option #10 with bi-directional capabilities (indicates flow in each direction) from McCrometer of Hemet, Calif. being one suitable example) to monitor the water flow rate. A portion of a water discharge pipe (during pumping operations) is indicated at 132. Pipe 132 may function as a supply pipe during aquifer recharge operations. Pressure at the well head may be monitored by a pressure gauge 134. It should be noted that other types of pumps may be used as the aquifer recharge valve is not limited to use with the type of pump depicted in FIG. 7.

Figure 8:
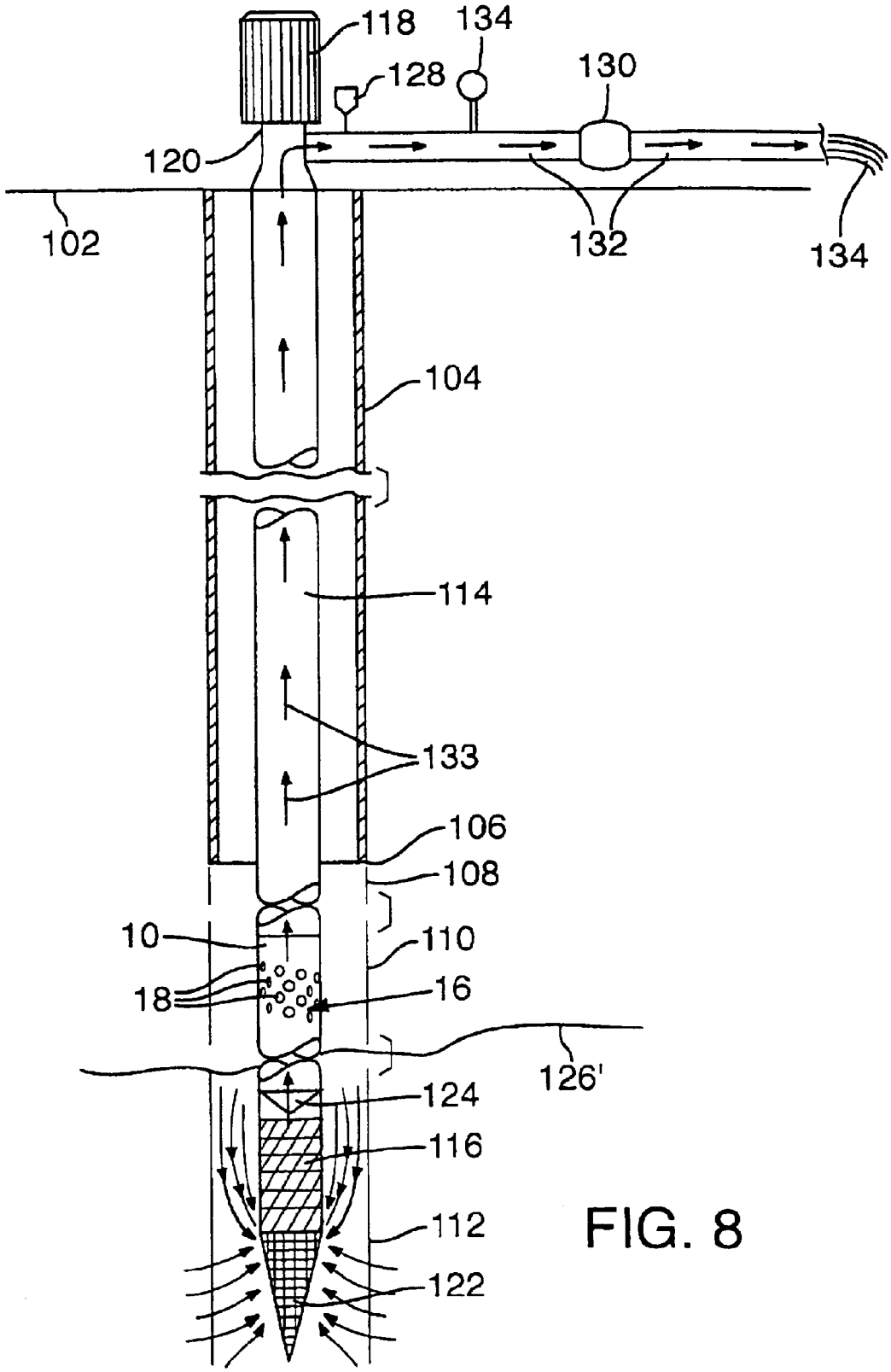
FIG. 8 is a view similar to FIG. 7 with the valve closed and showing water being pumped from the well.

FIG. 8 illustrates the embodiment of FIG. 7 in which the well is being operated in a normal pumping operation. In this case, the valve 20 has been shifted to a closed position to block the flow of water through apertures 18. As the pump operates, water passes screen 122 and flows in the direction indicated schematically by arrows 133 to the surface of the well and through discharge pipe 132. The water is indicated schematically at 134 exiting from pipe 132. Check valve 124 prevents the backflow of water through pump bowls 116. In this figure, the water level 126' is schematically shown as having a concave dip as water is being drawn from the aquifer into the pump column. No water is shown flowing through openings 18 as these openings are closed in this specific example.

Figure 9:
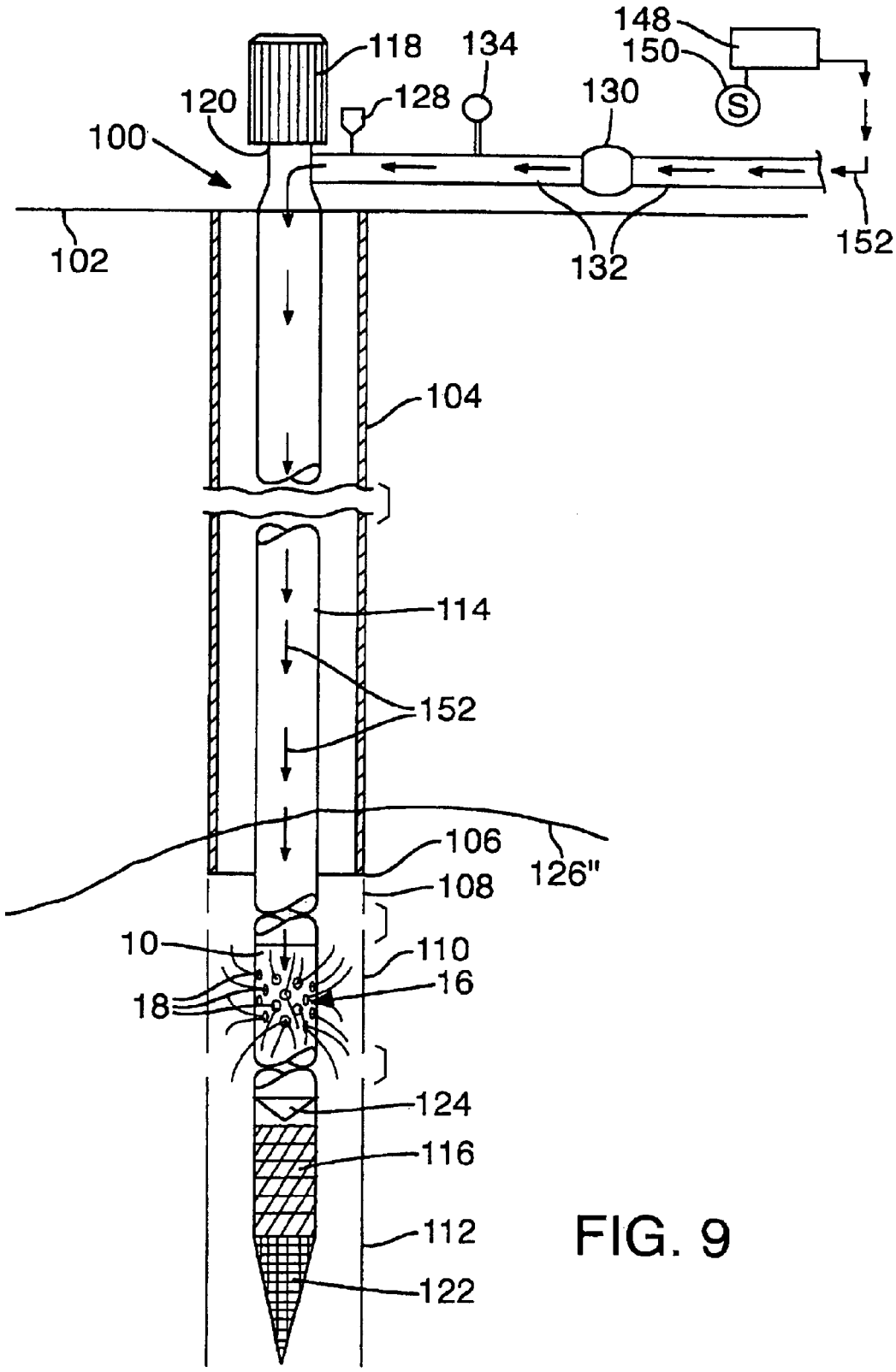
FIG. 9 is a view similar to FIG. 7 with the valve open and water being recharged into the aquifer.

Next assume it is desired to shift from the conditions of FIG. 7 or FIG. 8 to the aquifer recharge operation shown in FIG. 9. In making this transition, the valve 20 is closed (or remains closed if it is already closed) to block the flow of water through the apertures 18. The pump is turned on to force water to the surface to fill up the pump column (if it is not already full). The pump is then shut off. The check valve 124 holds the column of water in the pump column. One fills the column and any pipe connected thereto with water so that air is not injected into the aquifer during recharge operations. Any such injected air can plug the aquifer. A pump, such as surface pump 148, is then energized to deliver water from a source 150 (such as a reservoir, lake, stream, tank or other storage area) in a direction indicated schematically by arrows 152 into pipe 132 and the well head. A positive pressure is maintained at the well head such as 10–20 psi. The valve is then opened by raising the cage with the extent of the valve opening being controlled to match the water flow rate into the well head at the surface. A controller, such as a programmable logic controller, may be used to control the positioning of the valve so that these flow rates are maintained in a manner that keeps a positive pressure at the well head. Thus, if the pressure drops, the valve 20 may be shifted to close the valve to a greater extent. If the pressure rises, the valve 20 may be opened to a greater extent. The valve 20 may be controlled by a hydraulic motor coupled to the respective cylinders 40, 42 and operable in response to the controller as explained below. As shown in FIG. 9, under these conditions the water level 126' is shown elevated as water is being injected into the aquifer through the openings 18. Check valve 124, in this example, prevents the water from flowing backward through the pump bowls. When it is desired to stop recharging the aquifer, the valve 20 may be closed to block the openings 18. In addition, the valve 20 may be opened to drain the water column to its static level (see FIG. 7).

Figure 11:
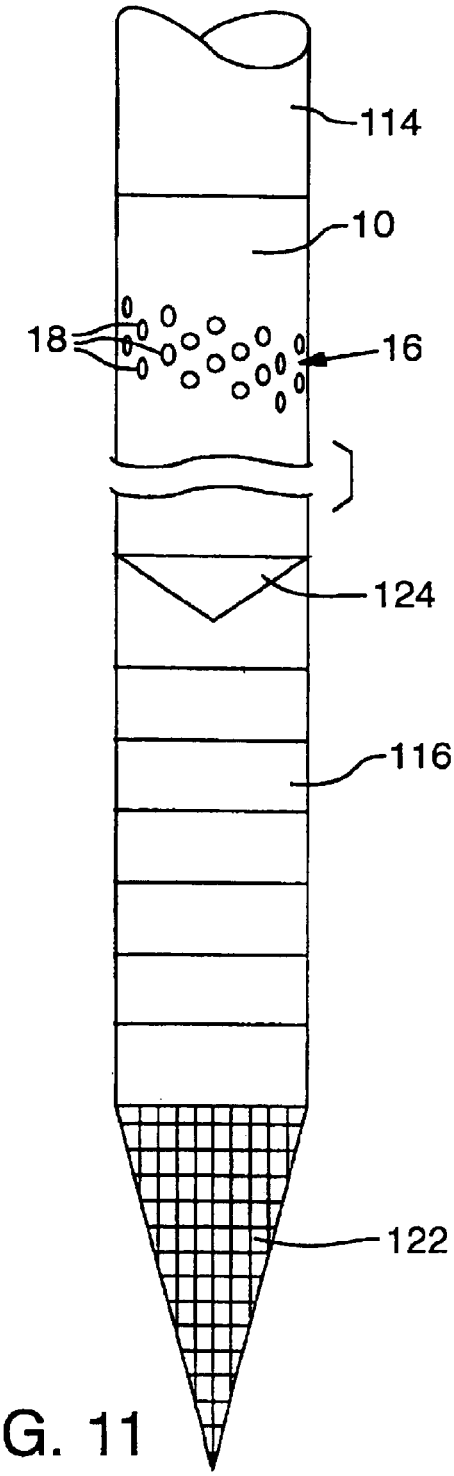
FIG. 11 illustrates an application with the valve positioned above the pump (similar to FIG. 7).

FIG. 11 is an enlarged view of a portion of the construction described in connection with FIGS. 7–9.

Figure 10:
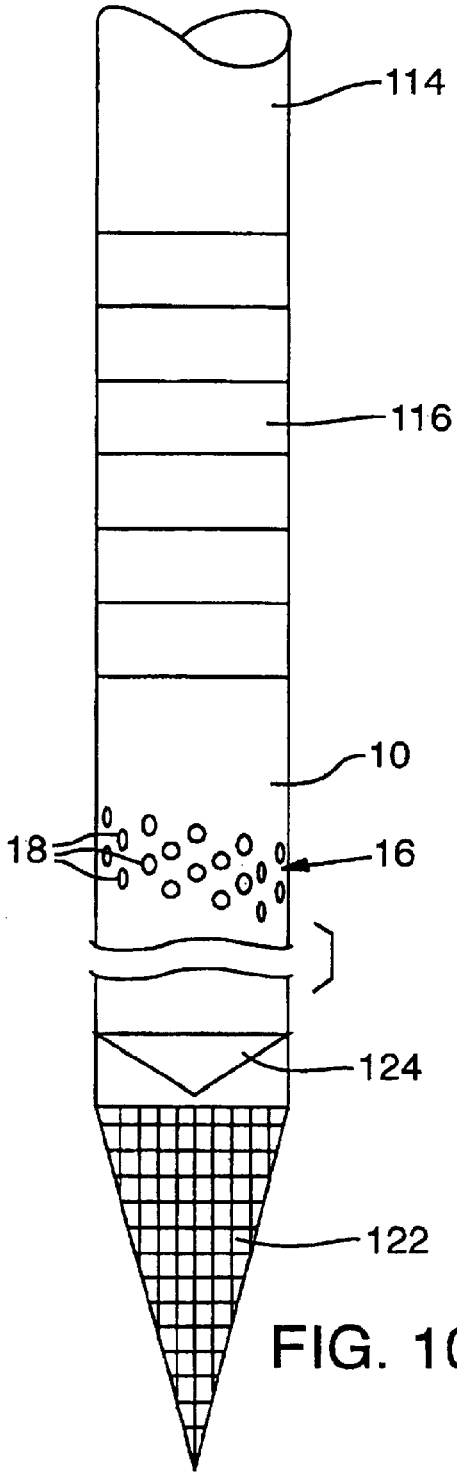
FIG. 10 illustrates an application in which the valve is positioned below the pump.

FIG. 10 illustrates an alternative construction in which the check valve 124 and aquifer recharge valve are positioned below the pump bowls and suction of the pump.

Figure 12:
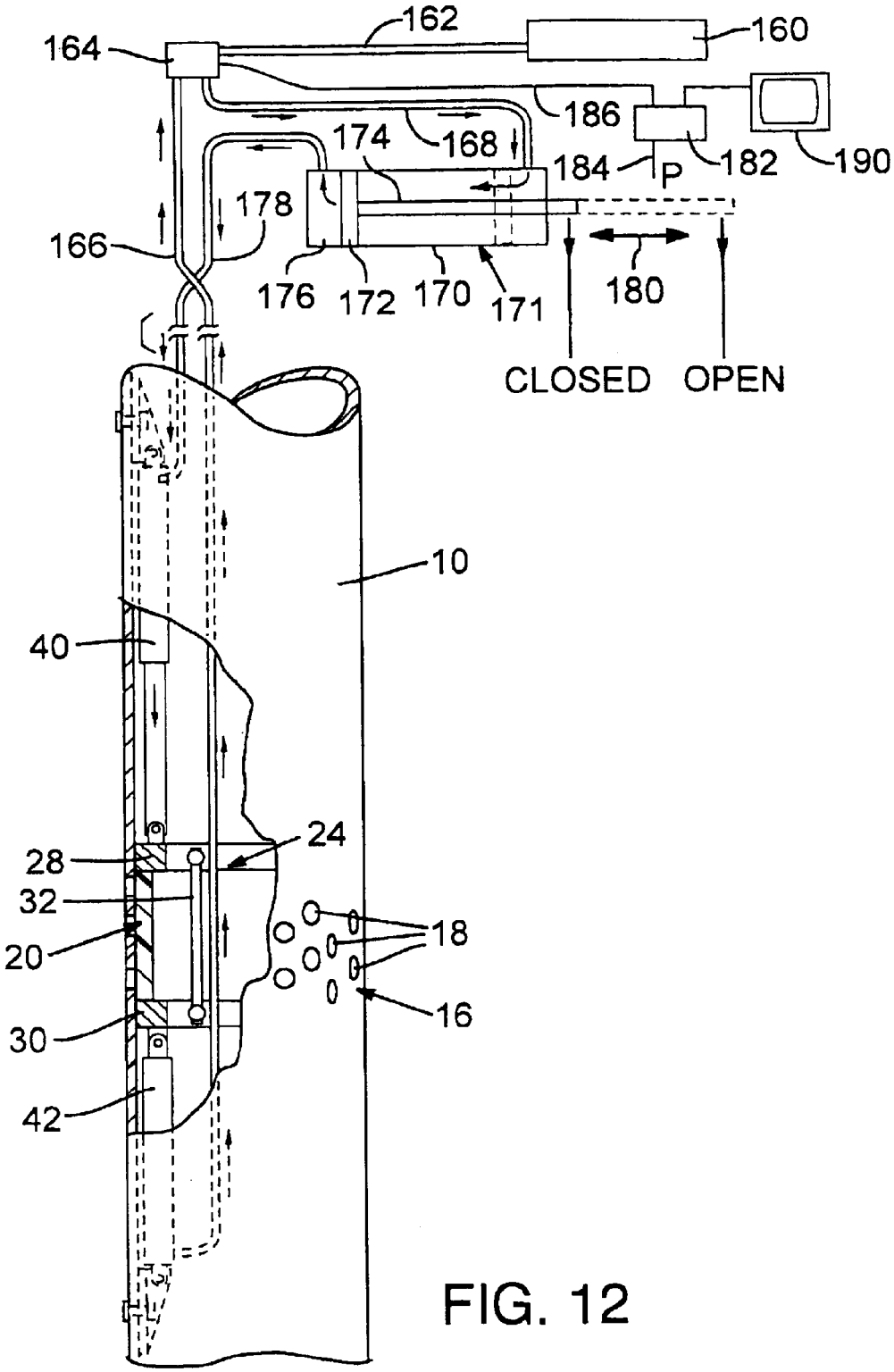
FIG. 12 illustrates one form of control for shifting the valve between open and closed positions with the valve shown in a closed position in FIG. 12.
Figure 13:
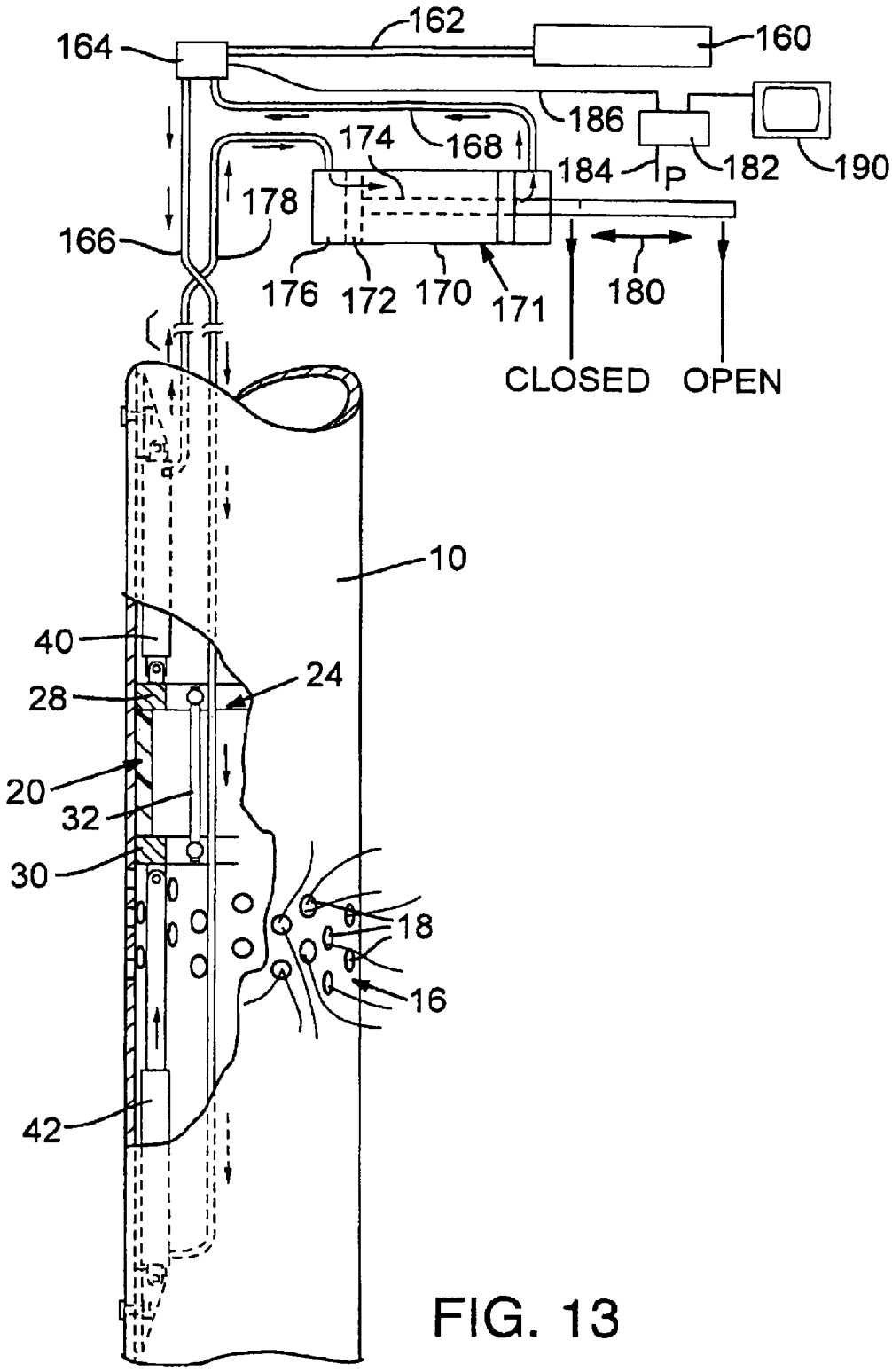
FIG. 13 is a view similar to FIG. 12 except the valve is shown shifted to an open position in FIG. 13.

FIGS. 12 and 13 illustrate an exemplary embodiment of a control useful in controlling the opening and closing of the valve 20.

In FIG. 12, the valve 20 is shown shifted to a closed position. In this example, a hydraulic pump 160 is coupled by a line 162 to a hydraulic pump control valve 164. Valve 164 is coupled to a line 166 extending from pump control valve 164 to the cylinder housing end of the cylinders 42. A line 168 may be coupled from control valve 164 to the cylinder housing end of the cylinders 40. However, in the illustrated embodiment, line 168 is coupled to one end portion 170 of a chamber 171. A piston 172 is positioned within chamber 171. An indicator, such as a rod 174, is coupled to piston 172 and projects outwardly from chamber 171. A second chamber 176, at the opposite side of piston 172 from chamber 170, is coupled by a line 178 to the cylinder housing end of the respective cylinders 40. When valve 164 is in the position shown in FIG. 12, hydraulic fluid is passed through line 168 into chamber 170 to drive piston 172 to the left in this figure. Piston 172 in turn forces hydraulic fluid from chamber 176 into line 178 and to the cylinder housing end of cylinders 40 to extend cylinders 40 and drive the valve 20 to a closed position. At the same time, hydraulic fluid is bled from the cylinder housing end of cylinders 42 via line 166. The position of the exposed end of rod 174 provides a visual indication of the extent to which the valve 20 is closed. Indicia and a pointer on the rod which moves along the indicia may be used to indicate the valve position. The rod comprises one form of a piston extension. Other mechanisms for detecting and visually indicating the position of the piston, and thereby of the recharge valve, may also be used. Remote indication of the valve position may also be provided. For example, a potentiometer may be coupled to rod 174 and be included in a circuit which provides an electrical signal at a remote location (spaced from the rod and desirably spaced from the well head) to indicate the position of the rod and thus the position of valve 20. In FIG. 12, the valve is shown in its fully closed position. The fully opened position is also indicated in FIG. 12. Components 160, 164 and 171 are typically above the ground where they are readily accessible and where it is easy to visually observe the position of rod 174. In general, during an aquifer recharge operation, piston rod 174 is movable in the direction as indicated by arrows 180 to various positions between the fully closed and fully opened position. A programmable logic controller 182 receives an input signal on line 184 which corresponds to the pressure P at the well head. Controller 182 is programmed to send a signal along line 186 to hydraulic pump control valve 164 to control the operation of the control valve to in turn shift the valve 20 toward open or closed positions to maintain the pressure at the well head within desired limits (e.g., 10 to 20 psi). A monitor or other visual display device 190 may also be included to provide further indications of the operating conditions of the system during aquifer recharging. Other indicators may alternatively be used.

Typically, food grade hydraulic fluid is used so as to protect the water supply in the event the hydraulic fluid leaks from the system. Although other lines may be used, the lines 166, 178, for example, may be one-fourth inch diameter stainless steel tubing.

The volume of chambers 170, 176 may be such that movement of piston rod 174 between the open and closed positions corresponds to the movement of the valve 20 between respective fully open and fully closed positions.

Although other components may be used, one exemplary control valve 164 is a Model No. 202-304 solenoid valve from Chief Manufacturing. A suitable logic controller 182 is a Panel View Model 300 controller from Allen Bradley.

FIG. 13 shows valve 20 as it is shifted to its fully opened position. In this case, hydraulic fluid is delivered through line 166 to the housing end of cylinders 42 to extend these cylinders and shift the valve 20 upwardly in FIG. 13. At the same time, hydraulic fluid passes from the housing side of cylinders 40 through line 178 and into chamber 176. Fluid from chamber 170 is bled through line 168.

Other control systems for controlling the operation of cylinders 40 and 42 to shift the valve 20 may be used as alternatives. For example, mechanisms such as a manual two-way spool valve may be used to control the shifting of valve 20.

Having illustrated and described the principles of my invention with reference to several preferred embodiments, it should be apparent to those of ordinary skill in the art that the invention may be modified in arrangement and detail without departing from such principles. I claim all such arrangements that fall within the scope of the following claims.

I claim:

1. An aquifer recharge valve assembly comprising:

a pipe section comprising a wall with an interior surface and an exterior surface;

at least one aperture extending through the wall; and a valve positioned within the interior of the pipe section and movable between a first closed position in which the valve overlies a portion of the interior surface of the wall and the at least one aperture and at least one open position wherein the valve is shifted so as to no longer overlie the at least one aperture at least in part such that aquifer recharge water may flow through the aperture and into the aquifer, wherein the valve has flexibility such that when the valve is in the closed position, a head of water pressure within the pipe section forces the valve outwardly against the overlaid at least one aperture.

2. An apparatus according to claim 1 wherein the valve comprises a seamless valve cylinder of a polymer material with an exterior surface which is sized to slide along the interior of the pipe section.

3. An apparatus according to claim 1 in which the valve comprises a valve body with a cylindrical exterior surface and with first and second end portions, the valve body comprising at least one opening through which water can flow between the first and second end portions, and a valve support coupled to the valve body.

4. An apparatus according to claim 3 wherein the valve support comprises a cage coupled to the respective first and second end portions of the valve body.

5. An apparatus according to claim 3 wherein the valve support comprises a first cross member coupled to the first end portion, a second cross member coupled to the second end portion, and a plurality of reinforcing members interconnecting the first and second cross members.

6. An apparatus according to claim 5 wherein the first and second cross members comprise respective annular rings.

7. An aquifer recharge valve assembly according to claim 1 comprising a visual indicator which is coupled to the valve and is operable to provide a visual indication of the position of the valve.

8. An aquifer recharge valve assembly according to claim 7 wherein the visual indicator comprises a piston in a hydraulic fluid delivery circuit operable to supply hydraulic fluid to the at least one hydraulic cylinder, the piston moving with the movement of the valve such that the position of the piston corresponds to the position of the valve.

9. An aquifer recharge valve assembly according to claim 8 in which the visual indicator comprises a piston position indicator coupled to the piston.

10. An aquifer recharge valve assembly according to claim 8 in which the piston position indicator comprises a piston extension coupled to the piston.

11. An aquifer recharge valve assembly according to claim 8 in which the piston position indicator comprises a potentiometer coupled to the piston.

12. An aquifer recharge valve assembly comprising:

a ripe section comprising a wall with an interior surface and an exterior surface;

at least one aperture extending through the wall; and a valve positioned within the interior of the pipe section and movable between a first closed position in which the valve overlies a portion of the interior surface of the wall and the at least one aperture and at least one open position wherein the valve is shifted so as to no longer overlie the at least one aperture at least in part such that aquifer recharge water may flow through the aperture and into the aquifer;

the valve comprising a valve body with a cylindrical exterior surface and with first and second end portions, the valve body comprising at least one opening through which water can flow between the first and second end portions, and a valve support coupled to the valve body; and wherein the valve body is a monolithic one-piece cylinder of polymer having a central water flow passageway extending between the first and second end portions, the cylinder having a wall thickness which allows the cylinder to resiliently expand against the interior surface of the wall in response to water pressure to assist in sealing the at least one aperture when the valve is positioned in the closed position.

13. An apparatus according to claim 12 wherein there are a plurality of apertures arranged in a spiral pattern about the circumference of the pipe section, wherein the valve is movable to various open positions corresponding to various apertures being no longer being overlaid by the valve to thereby vary the recharge water flow rate through the valve and into the aquifer.

14. An aquifer recharge valve assembly for a well comprising:

an elongated pipe section comprising a wall with an interior surface and an exterior surface;

a plurality of apertures through the wall of a portion of the pipe section having a length, at least some of the apertures being at different locations along a length of the pipe section portion;

a valve positioned within the pipe section and comprising a cylindrical aperture closing section slidable along the length of the pipe section portion and along the interior surface of the wall between a first closed position and open positions, wherein when in the first closed position the aperture closing section overlies and closes the apertures, wherein when the aperture closing section is in open positions, the aperture closing section does not overlie and close the apertures, the flow rate through the valve being varied by the extent to which the apertures are not overlaid when the valve is in the various open positions, the valve being of a resilient material such that, upon installation of the valve assembly in a well, head pressure of water within the well urges the valve closing section outwardly and against the interior surface of the wall at least when the valve is in the closed position;

a valve support coupled to the valve and movable with the valve; and at least one hydraulic cylinder coupled to the valve support and to the wall of the pipe section and operable to shift the valve between the first closed position and the open positions.

15. An aquifer recharge valve assembly according to claim 14 in which the flow rate increases as the valve is shifted from the closed position to a fully open position.

16. An aquifer recharge valve assembly according to claim 15 in which the flow rate increases linearly as the valve is shifted from the closed position to the fully open position.

17. An aquifer recharge valve assembly according to claim 14 wherein the apertures are arranged in a spiral pattern about the length of the pipe section portion.

18. An aquifer recharge valve assembly according to claim 14 wherein at least a plurality of the apertures are bounded by rounded edges at the interior surface.

19. An aquifer recharge valve assembly according to claim 14 wherein the valve support comprises a cage.

20. An aquifer recharge valve assembly according to claim 14 wherein the valve comprises first and second end portions and wherein the valve support comprises a first cross member coupled to the first end portion, a second cross member coupled to the second end portion, and a plurality of reinforcing members interconnecting the first and second cross members.

21. An aquifer recharge valve assembly according to claim 20 wherein the valve body is a monolithic one-piece cylinder of polymer having a central water flow passageway extending between the first and second end portions, the cylinder having a wall thickness which allows the cylinder to resiliently expand against the interior surface of the wall in response to water pressure within the well to assist in sealing the at least one aperture when the valve is in the closed position.

22. An aquifer recharge valve assembly according to claim 14 comprising:

a first hydraulic cylinder coupled to the valve support and to the wall of the pipe section, the first hydraulic cylinder being operable to shift the valve support and valve from the first closed position toward the open positions upon extension of the first hydraulic cylinder; and a second hydraulic cylinder coupled to the valve support and to the wall of the pipe section, the second hydraulic cylinder being operable to shift the valve support and valve from open positions toward the closed position upon extension of the second hydraulic cylinder.

23. An aquifer recharge valve assembly according to claim 14 which comprises a hydraulic circuit through which operating fluid is supplied to the at least one hydraulic cylinder, the valve assembly comprising a visual valve position indicator coupled to the hydraulic circuit and operable to visually indicate the position of the valve within the pipe section.

24. An aquifer recharge valve assembly according to claim 23 in which the valve position indicator comprises a piston and cylinder in the hydraulic circuit, the piston being moved with the valve, whereby the position of the piston visually indicates and corresponds to the position of the valve.

25. An aquifer recharge valve assembly according to claim 24 comprising a movable member coupled to the piston for movement with the piston, the position of the movable member visually indicating the position of the valve.

26. An aquifer recharge valve assembly according to claim 23 in which the visual valve position indicator visually indicates the position of the valve at a remote location.

27. An aquifer recharge system comprising:

a pipe section;

valve means positioned within the pipe section and shiftable between open and closed positions;

the valve means comprising resilient aperture closing means urged against overlaid apertures of the nine section to close such apertures, the valve means having flexibility such that when the valve means is positioned to overlie apertures of the nine section, water pressure from a head of water within the pipe section forces the valve outwardly against the overlaid apertures; and hydraulic valve shifting means coupled to the valve means for shifting the valve means between open and closed positions.

28. An aquifer recharge system according to claim 27 further comprising visual indicator means remote from the pipe section for indicating the position of the valve means.

29. A method of recharging a well comprising:

placing a pipe section containing a water recharge valve in a well section;

resiliently urging a flexible section against the interior of the pipe section to close apertures through the pipe section overlaid by the valve section; and shifting the flexible valve section within the pipe section to vary the extent to which the apertures are overlaid and to thereby control the flow of recharge water through the apertures.

30. A method according to claim 29 comprising the act of visually indicating the position of the valve.

* * * * *

UNITED STATES PATENT AND TRADEMARK OFFICE

CERTIFICATE OF CORRECTION

PATENT NO. : 6,811,353 B2
DATED : November 2, 2004
INVENTOR(S) : Kent R. Madison It is certified that error appears in the above-identified patent and that said Letters Patent is hereby corrected as shown below:

Column 8,
Line 39, “ripe section” should read -- pipe section --.

Column 10,
Line 44, “nine section” should read -- pipe section --

Signed and Sealed this

Seventeenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,811,353 B2
APPLICATION NO. : 10/197055
DATED : November 2, 2004
INVENTOR(S) : Kent R. Madison It is certified that error appears in the above-identified patent and that said Letters Patent is hereby corrected as shown below:

In the Specification:

Column 10, line 41, “nine section” should read -- pipe section --.

Signed and Sealed this
Sixteenth Day of October, 2012

David J. Kappos

David J. Kappos
*Director of the United States Patent and Trademark Office*